US007478704B2

(12) United States Patent
Church

(10) Patent No.: US 7,478,704 B2
(45) Date of Patent: Jan. 20, 2009

(54) LIFT CART

(76) Inventor: Clyde M. Church, 2422 N. Alamo Cir., Mesa, AZ (US) 85213

( * ) Notice: Subject to any disclaimer, the term of this patent is extended or adjusted under 35 U.S.C. 154(b) by 426 days.

(21) Appl. No.: 10/893,858

(22) Filed: Jul. 19, 2004

(65) Prior Publication Data

US 2006/0045696 A1 Mar. 2, 2006

(51) Int. Cl.
*B66F 9/20* (2006.01)
*B66F 9/06* (2006.01)
*B66F 9/22* (2006.01)

(52) U.S. Cl. ..... 187/234; 187/223; 187/231; 187/233

(58) Field of Classification Search ..... 187/231, 187/233, 234; 414/490
See application file for complete search history.

(56) References Cited

U.S. PATENT DOCUMENTS 2,653,678 A * 9/1953 Lehrman ..... 187/222
3,302,927 A * 2/1967 Gray ..... 254/2 B
3,433,324 A * 3/1969 McIntosh ..... 187/222
4,571,142 A 2/1986 Niewald et al. ..... 414/427
4,961,316 A * 10/1990 Corke et al. ..... 60/431
5,083,892 A 1/1992 Oswald et al. ..... 414/458
5,174,415 A * 12/1992 Neagle et al. ..... 187/234
5,911,408 A 6/1999 Berends et al. ..... 254/2 B
2006/0231343 A1* 10/2006 Vesa ..... 187/233

* cited by examiner

*Primary Examiner*—Peter M Cuomo
*Assistant Examiner*—Eric Pico
(74) *Attorney, Agent, or Firm*—Cahill, von Hellens & Glazer P.L.C.

(57) ABSTRACT

A wheeled cart includes a lift platform mounted for vertical movement on a frame, an actuating system for effecting movement of the platform, a brake system acting against a wheel to prevent movement of the cart, a tank containing compressed air and an air conduit system for directing compressed air to the actuating system and the brake system.

5 Claims, 2 Drawing Sheets

LIFT CART

TECHNICAL FIELD

This invention is concerned with the safe lifting and transport of heavy items in a manufacturing environment. Specifically, the cart is useful in a tire manufacturing facility for transporting precure rubber rolls from the rubber stocking area to a tread rubber builder or retread apparatus and where a supply of compressed air is available to power the lift feature of the cart.

BACKGROUND ART

Wheeled vehicles for transporting and lifting heavy objects are in widespread use.

U.S. Pat. No. 5,083,892 granted Jan. 28, 1992 to N. D. Oswald et al. for "Aerial Weapons Handling Trailer" discloses a device for transporting bombs and lifting them into the bomb bay of an aircraft. The lifting mechanism is hydraulically operated and requires a highly complex control system.

U.S. Pat. No. 5,911,408 granted Jun. 15, 1999 to J. Berends et al. for "Transportable Lift" discloses a lift in which the main transport wheels of the lift are disabled when a load is placed on the lift. While the lift itself is transportable the load itself cannot be transported.

U.S. Pat. No. 4,571,142 granted Feb. 18, 1986 to J. L. Niewald et al. for "Mechanism for Lifting Vehicle Tires" discloses a hydraulic jack on a wheeled dolly for lifting and transporting vehicle tires.

There continues to be a need for a lift cart that can take advantage of compressed air available in the manufacturing facility to power its mechanisms.

SUMMARY OF THE INVENTION

The lift cart of this invention includes a tank containing compressed air for actuating both the lifting mechanism and the braking mechanism of the cart.

The cart of this invention has a frame mounted on wheels and carrying a lift platform mounted for vertical movement, an actuating system for effecting movement of the platform, brake means for acting against a wheel to prevent movement of the cart, a tank containing compressed air and air conduit means for directing compressed air from the tank to the actuating means and the brake means.

Strategically placed valves in the air conduit means selectively direct or prevent compressed air to flow to the braking means and components of the actuating means which include a hydraulic fluid reservoir, a lift cylinder and a shut-off valve in a hydraulic line between the reservoir and the cylinder.

BRIEF DESCRIPTION OF THE DRAWINGS

The invention is described in greater detail hereinafter by reference to the accompanying drawings wherein.

DETAILED DESCRIPTION OF THE INVENTION

Figure 1:
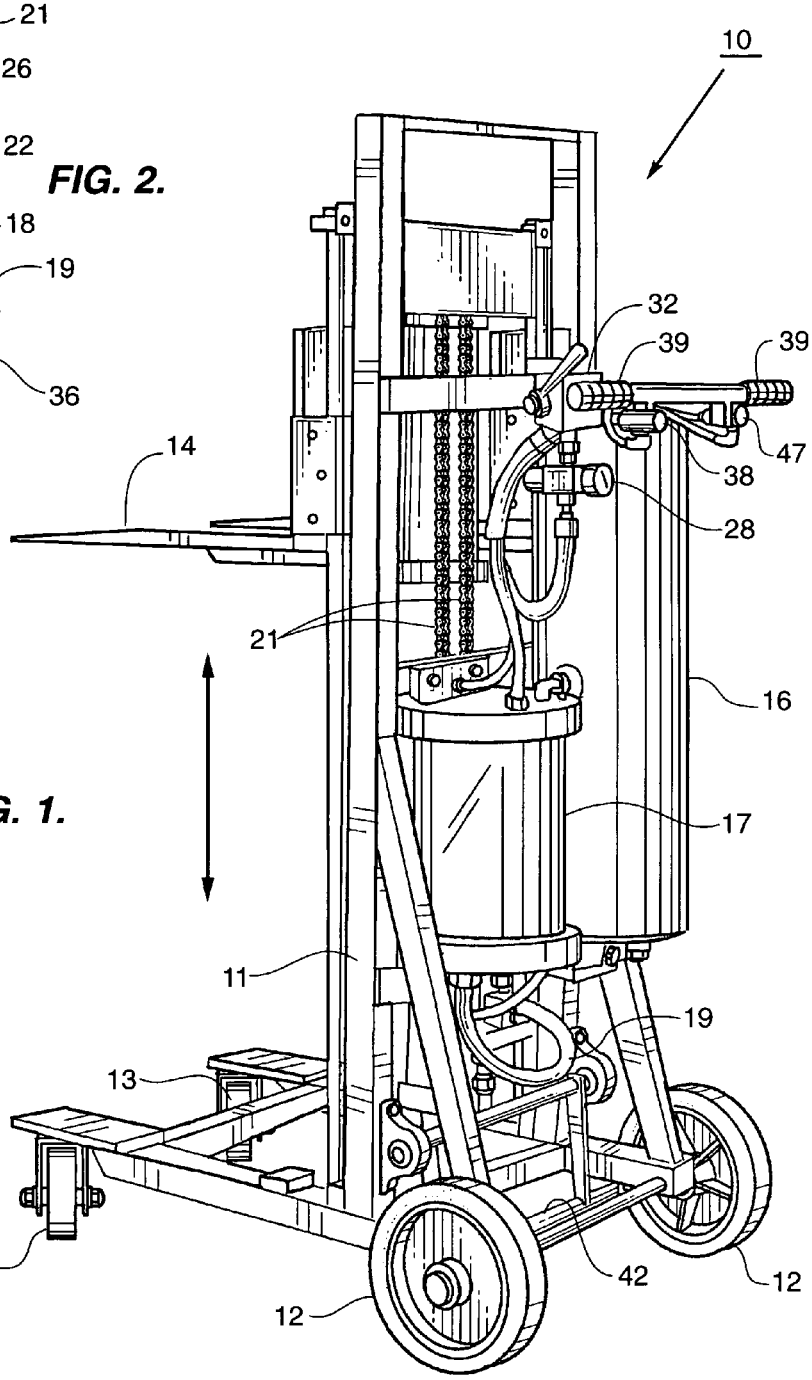
FIG. 1 is a perspective elevational view of a lift cart incorporating this invention.

Referring particularly to FIG. 1 the reference numeral 10 designates generally the lift cart of this invention. The lift cart

10 includes a frame 11 mounted for movement over a surface on a pair of rear wheels 12 and a pair of front casters 13.

Mounted for vertical movement on the frame 11 is a lift platform 14. The lift cart 10 of this invention is employed in a manufacturing environment for lifting and transporting heavy objects safely. For example in a tire building or retreading facility the lift platform 14 can be raised and positioned adjacent an elevated storage position for a roll of precure rubber. With the rubber on the platform 14 the latter is lowered to its lowermost position so the cart can be moved safely to the tire building or retread apparatus. The platform can then again be raised to a convenient height from which the rubber can be off-loaded to the apparatus.

As will be explained in detail hereinafter, brake means associated with the wheels 12 lock the wheels against movement when the platform 14 is in any elevated position above its lowermost position.

In accordance with this invention the mechanical activities of the cart 10, namely raising and lowering the platform 14 and actuating the braking means, are controlled by compressed air stored in a tank 16 mounted on the cart frame 11.

The actuating system for effecting up and down movement of the platform 14 includes a hydraulic fluid reservoir 17, preferably containing oil, and a hydraulic lift cylinder 18. A hydraulic fluid conduit 19 connects the reservoir 17 with the cylinder 18.

Figure 2:
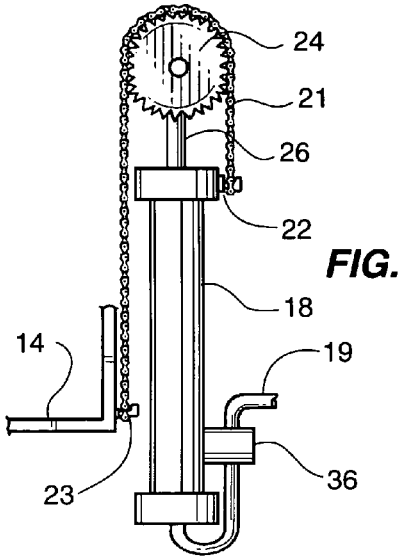
FIG. 2 is a partial elevational view of a hydraulic cylinder lift mechanism employed in the lift cart.

The mechanical link between the hydraulic cylinder 18 and the lift platform 14 may take a variety of forms, but preferably takes the form of the sprocket and chain connection illustrated in FIG. 2. A pair of chains 21 having fixed ends 22 attached to the cart frame 11 pass over a pair of sprockets 24 carried on the upper end of the cylinder connecting rod 26. The opposite, or free, ends 23 of the chains 21 are affixed to the platform 14. Movement of the piston (not shown) in the cylinder effects a 2 for 1 movement of the platform 14.

Figure 3:
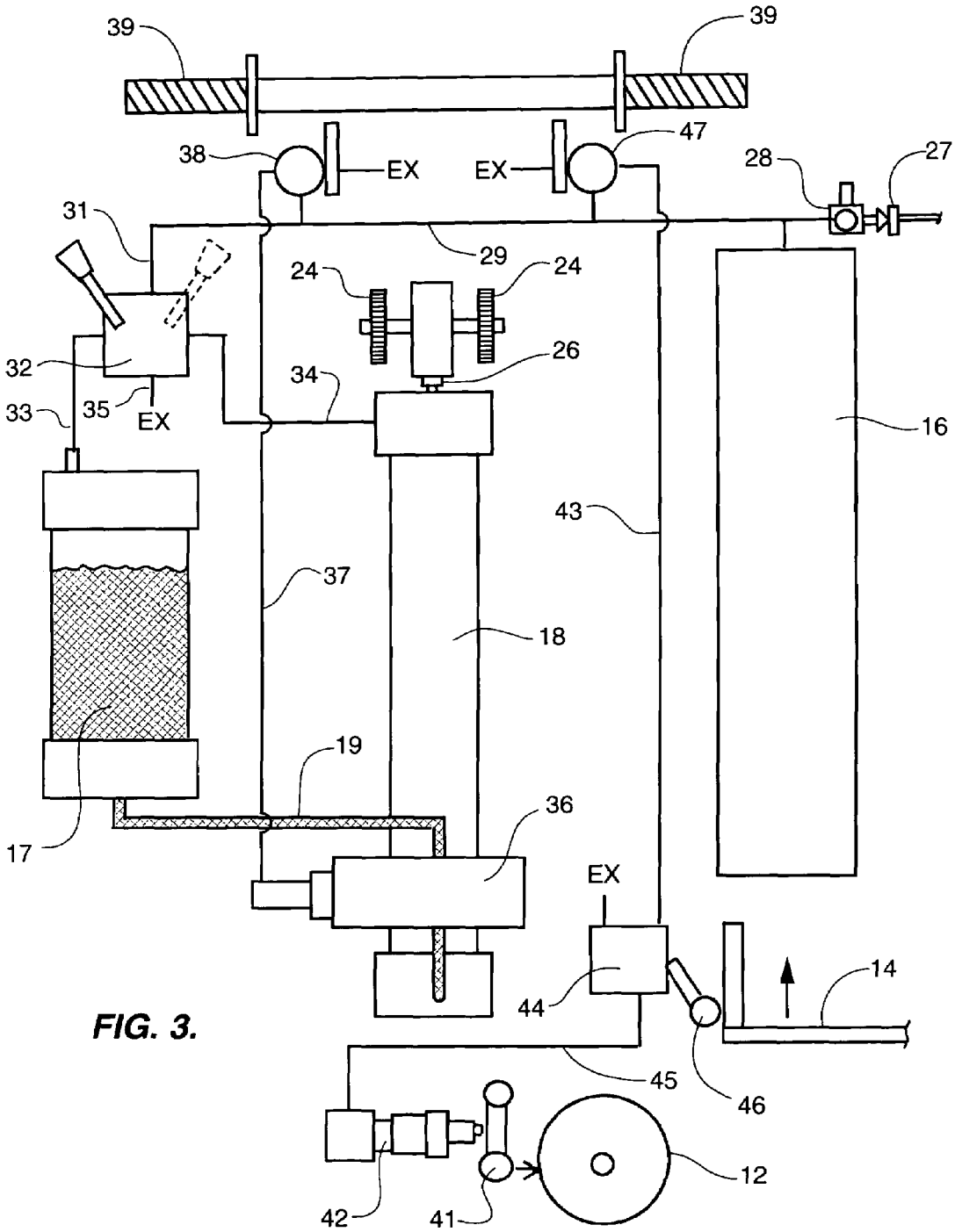
FIG. 3 is a circuit diagram of the air and hydraulic circuits and associated components of the lift cart.

The manner in which compressed air from tank 16 is employed to control and activate the actuating system effecting movement of the platform 14 is best illustrated in FIG. 3.

Compressed air is supplied to tank 16 via a check valve 27 and the tank may include a pressure gauge 28. Air conduit means includes a main air conduit 29 for conveying compressed air to other components of the lift cart 10.

A lateral 31 of the air conduit means conveys compressed air to a two position, 4 way hand valve 32 which in one position directs compressed air through a lateral conduit 33 to hydraulic fluid reservoir 17 and connects another lateral conduit 34 from the top of cylinder 18 to exhaust 35. This is the position valve 32 is placed in to raise the platform 14 and in that position it directs compressed air into reservoir 17 forcing hydraulic fluid out of the reservoir into cylinder 18.

In its other position valve 32 directs compressed air through lateral 34 to the top of cylinder 18 and connects reservoir lateral 33 to exhaust 35. This permits compressed air to propel the piston inside cylinder down, forcing hydraulic fluid back into reservoir 17. This lowers platform 14.

A further control arrangement for the platform actuating system is provided by a pneumatically actuated normally closed shut-off valve 36 in the hydraulic fluid conduit 19. Shut-off valve 36 is manipulated by compressed air supplied from a lateral conduit 37 through a manually actuated normally closed valve 38. Valve 38 is preferably actuated by a push button and is mounted near a hand grip 39 on the cart frame 11. In its normally closed position (push button not depressed) valve 38 blocks the passage of compressed air from main conduit 29 to lateral 37 and connects that lateral to exhaust. In its open position (push button depressed) valve 38 closes the exhaust and directs compressed air from main conduit 29 to lateral 37 to open shut-off valve 36 in the hydraulic fluid conduit 19.

It should thus be appreciated that regardless of the position of hand valve 32 the lift platform will move only when valve 38 is opened (push button depressed) causing shut-off valve 36 to open permitting hydraulic fluid to flow through fluid conduit 19. Thus by the simple manipulation of push button to close valve 38 the operator can stop the platform at any desired elevation and rest assured that the platform is "locked" in that position.

As mentioned previously, it is in accordance with this invention that the lift cart 10 includes means for braking the cart against movement over a surface when the platform 14 is elevated above its lowermost position. This braking means includes a pivotally mounted brake bar 41 adapted to be pressed against the rear wheels 12 of the cart by pneumatically actuated brake cylinder 42.

Brake cylinder 42 receives compressed air through lateral air conduits 42 and 45 having a 3 way, normally open cam operated valve 44 therebetween. Valve 44 is manipulated to a closed position by a roller lever 46 positioned to be engaged by a portion of the lift platform 14 when, but only when, the platform 14 is in its lowermost position. With the roller lever thus engaged conduit 43 is closed and conduit 45 is opened to exhaust. When the platform is moved upwardly from its lowermost position the roller lever 46 is disengaged and spring biased valve 44 opens conduit 43 to conduit 45 admitting compressed air to brake cylinder 42 applying the brake to the wheels.

This braking feature is intended primarily to prevent the lift cart 10 from being moved any distance with the platform elevated and a load in place—a move which might result in the cart tipping over. However, there may be instances in which it is desired to move the cart some small amount with the platform and load elevated. this might occur when the cart has been stopped at a work station and the elevated load is slightly out of position to be deposited at the work station. The lift cart 10 of this invention is thus provided with means for operator override of the braking mechanism.

This brake override feature is provided by a 3 way, normally open brake release valve 47. Valve 47 is normally open, but can be manually manipulated by a push button to close off main conduit 29 and open conduit 43 to exhaust. This allows brake cylinder 42 to retract releasing brake bar 41 from the wheels 12 of the cart. Valve 47 also is preferably positioned close to a hand grip 39 on the cart frame.

From the foregoing it should be apparent that this invention provides a safe, reliable lift cart for lifting and transporting heavy objects.

What is claimed is:

1. A lift cart comprising:

a frame, a wheel on said frame permitting the cart to be moved over a surface, brake means on said frame and adapted to act against said wheel to prevent movement of the cart over the surface, a lift platform mounted on said frame for vertical movement thereon, an actuating system for effecting movement of said platform, a tank for containing compressed air mounted on said frame, and air conduit means for directing compressed air from said tank to said brake means and said actuating system, said actuating system comprising a reservoir containing hydraulic fluid, a lift cylinder, a hydraulic fluid conduit connecting said reservoir and said lift cylinder, and a pneumatically actuated shut-off valve in said hydraulic fluid conduit, a manually actuated valve in said air conduit means for controlling the flow of compressed air to said reservoir, whereby compressed air from the tank may controllably be admitted to the reservoir containing hydraulic fluid for actuating the lift cylinder and effecting movement of the platform.

2. The lift cart of claim 1 wherein:

the air conduit means between said tank and said brake means includes a valve adapted to be actuated by movement of said platform.

3. The lift cart of claim 2 further including:

a second valve in the air conduit means between said tank and said brake means, said second valve being manually actuatable to override the valve actuated by movement of said platform.

4. The lift cart of claim 3 further including a hand grip on said frame and said second valve is positioned in close proximity to said handgrip.

5. A lift cart comprising:

a frame, a lift platform mounted on said frame for vertical movement thereon, an actuating system for effecting movement of said platform, a tank for containing compressed air mounted on said frame, air conduit means for directing compressed air to said actuating system, said actuating system comprising a reservoir containing hydraulic fluid, a lift cylinder, a hydraulic fluid conduit connecting said reservoir and said cylinder, and a pneumatically actuated shut-off valve in said hydraulic fluid conduit, a first manually actuated valve in said air conduit means for controlling the flow of compressed air to said reservoir, and a second manually actuated valve in said air conduit means for controlling the flow of compressed air to said shut-off valve whereby compressed air from the tank may controllably be admitted to the reservoir containing hydraulic fluid for actuating the lift cylinder and effecting movement of the platform.

* * * * *